United States Patent [19]

Bach et al.

[11] 4,124,949

[45] Nov. 14, 1978

[54] CONNECTOR AND BEARING FOR SWINGABLY MOUNTING ROD

[75] Inventors: Erik Bach, Billund; Jan Ryaa, Randbol, both of Denmark

[73] Assignee: Interlego A.G., Switzerland

[21] Appl. No.: 808,040

[22] Filed: Jun. 20, 1977

[30] Foreign Application Priority Data

Jul. 30, 1976 [DK] Denmark ..... 3444/76

[51] Int. Cl.[2] ..... A63H 33/08

[52] U.S. Cl. ..... 46/23

[58] Field of Search ..... 46/23, 16, 17, 25, 26, 46/29, 22; 74/40, 42

[56] References Cited

U.S. PATENT DOCUMENTS

| | | | |
|---|---|---|---|
| 2,752,726 | 7/1956 | Calverly | 46/22 |
| 2,775,899 | 1/1957 | Vagneur | 74/40 X |
| 3,475,849 | 11/1969 | Fischer | 46/16 |
| 3,747,261 | 7/1973 | Salem | 46/26 |

FOREIGN PATENT DOCUMENTS

| | | | |
|---|---|---|---|
| 254,835 | 1/1949 | Switzerland | 46/16 |

*Primary Examiner*—F. Barry Shay

*Attorney, Agent, or Firm*—Stevens, Davis, Miller & Mosher

[57] ABSTRACT

A connector for converting a reciprocating movement of one element of a toy building set into a rotating movement of another element by means of a swingable connecting rod interconnecting the two elements.

The connector comprises a first tubular member pivotally mounted in a bearing housing arranged for reciprocal movement between a pair of guides, and a second tubular member disposed at a right angle relatively to the first tubular member and adapted to receive one end of the connecting rod, the other end of which being swingably mounted on a rotating disc by means of a similar connector.

5 Claims, 7 Drawing Figures

CONNECTOR AND BEARING FOR SWINGABLY MOUNTING ROD

This invention relates to a connecting member for toy building sets and more particularly to a connector mounting a connector rod in a bearing housing comprising a hollow open faced building element pertaining to a building set of the kind described in U.S. Pat. No. 3,005,282.

Such building sets generally consist of hollow box-shaped building elements having a rectangular bottom face and four side walls defining a cavity, the outer face of the bottom being provided with coupling studs, generally designated as primary projections. Within the cavity of such elements there may be provided other coupling studs known as secondary projections adapted to co-operate with the primary projections for connecting a pair of adjacent building elements.

Moreover, such building sets may include a plurality of other elements such as wheels, pinions, shafts adapted to be combined with the standard elements referred to for rotational movement relatively to structures formed by various combinations of the standard elements.

In such structure including rotatably disposed parts purporting to simulate mechanical constructions such as power transmissions or the like, it may be desirable to provide additional elements adapted to convert a reciprocating movement into a rotation or vice versa.

The main object of the invention, therefore, is to provide a simple and inexpensive element which will enable the user of the building set to make constructions including a swingable connecting rod between a reciprocating and a rotable element.

Figure 1:
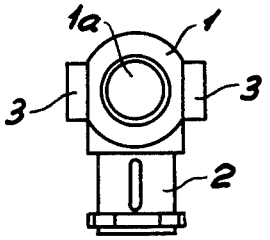
Figure 3:
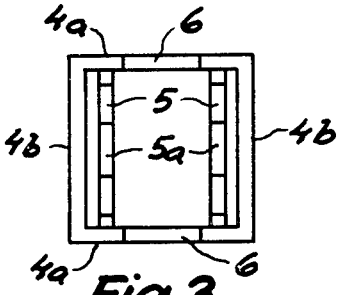
Figure 4:
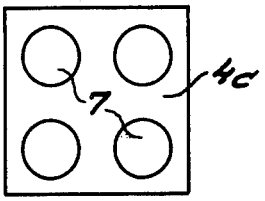
Figure 2:
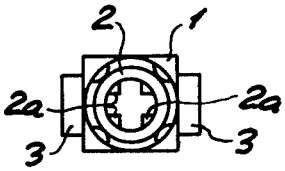
Figure 5:
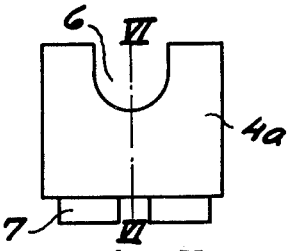
Figure 6:
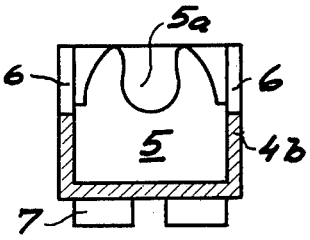
Figure 7:
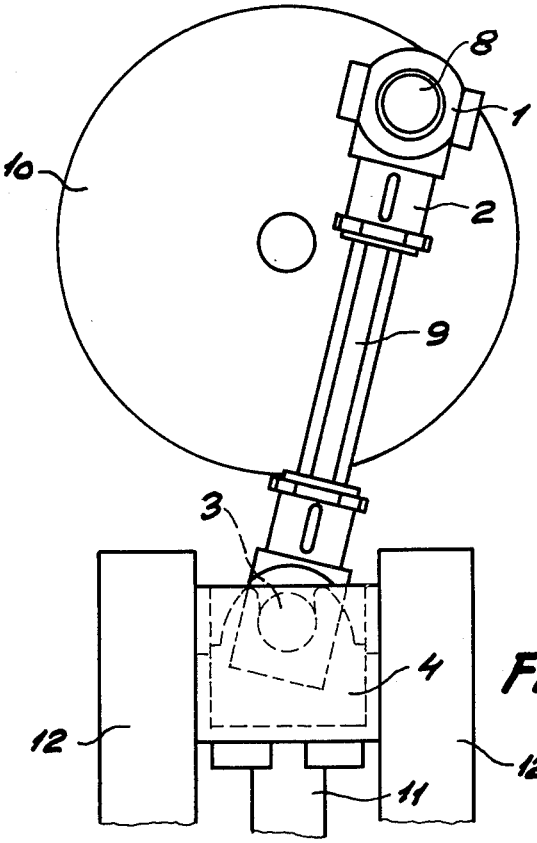

This and other features of the invention will now be described with reference to the accompanying drawings, in which:

FIG. 1 is a side elevation showing an embodiment of a connector member in a bearing housing, FIG. 2 is a bottom view of the member shown in FIG. 1, FIG. 3 is a top view of a bearing housing including bearings for pivotally mounting the member shown in FIGS. 1 and 2, FIG. 4 is a bottom view of the bearing housing shown in FIG. 3, FIG. 5 is a side elevation of the same bearing housing, FIG. 6 is a sectional view taken on the line VI—VI of FIG. 5 and FIG. 7 is a side elevation showing the use of the connector and a connecting rod for interconnecting a pair of elements adapted to rotational and reciprocating movements respectively.

The connecting member shown in FIGS. 1 and 2 comprises a pair of tubular elements such as sleeves 1 and 3 disposed at right angle relatively to one another. One of these sleeves, 1, is provided with a pair of cylindrical pivots 3 extending laterally from either side thereof with their axes intersecting the axis of the sleeve 1 at a right angle. The other sleeve 2 is adapted to receive one end of a connecting rod 9 as shown in FIG. 7 and is preferably provided with ribs 2*a* adapted to engage corresponding slits (not shown) in the connecting rod 9.

The pivots 3 of the sleeve 1 are adapted to be mounted in a pair of bearings 5*a* in the bearing shown in FIGS. 3, 4, 5 and 6. In the embodiment shown in these figures, the bearing housing comprises a modified standard building element pertaining to the building set i.e. an open faced block having a square bottom 4*c* as shown in FIG. 4 and two pairs of oppositely disposed side walls 4*a* and 4*b*. The modification of this standard element according to the invention consists in the provision of substantially U-shaped recesses forming bearings for the pivots 3 of the sleeve 1. These recesses 5*a* may be provided either in a pair of plate elements in the form of internal walls 5 integral with the bottom face 4*c* of the housing within the cavity thereof and extending parallel to the side walls 4*b* as shown in FIG. 3, or in the side walls 4*b*.

It will be understood that the upper edges of the side walls 4*a* will limit the angular movements of the swingable connector 1 and 2 within the housing which in FIG. 7 is generally designated as 4. Therefore, if it is desired to enable the connector to swing within an angle of 180° so as to coincide with a plane parallel to the bottom face 4*c* of the housing, the side walls 4*a* must be provided with recesses 6 permitting for such oscillations.

As shown in FIGS. 4, 5 and 6, the bottom 4*c* of the housing is provided with coupling studs 7 (primary projection) for interconnecting the housing element with other elements of the building set. More particularly, these projections may be used for connecting one end of a piston rod 11 as shown in FIG. 7 by clamping the end of the piston rod in between four primary studs 7 disposed as shown in FIG. 4.

The structure shown in FIG. 7 comprises a wheel or disc 10 provided with an excentrically disposed pivot 8 adapted to be received within the bore 1*a* of the sleeve 1 of FIG. 1, so as to provide for oscillatory movements of the connector 1,2 relatively to the wheel 10 during the rotation thereof. One end of the connecting rod 9 is introduced into the bore of the sleeve 2 and the other end of the connecting rod 9 is introduced into a corresponding sleeve of another connector pivotally mounted in a bearing housing 4 which is slideably mounted between a pair of guides 12 for reciprocal movements relatively thereto by means of the piston rod 11. Thus, with the structure schematically shown in FIG. 7, the reciprocal movements of the piston rod 11 provide for rotational movements of the wheel 10 or vice versa.

What we claim is:

1. A connector for swingable mounting of a connecting rod in a toy building set, said connector comprising:

(a) a bearing housing comprising a hollow open faced toy building element having a bottom and four walls and a pair of oppositely disposed substantially U-shaped recesses defining a pair of bearings, (b) a swingable member comprising a pair of tubular elements disposed at a right angle relatively to one another, one of said tubular elements having a pair of cylindrical pivots extending at either side thereof of a size adapting them to be laterally inserted into said recesses for pivotal mounting in said bearings, the other tubular element having it's bore adapted to receive one end of a connecting rod.

2. A connector as claimed in claim 1 in which the bottom face of the bearing housing is square and provided with four cylindrical outwardly projecting coupling studs the diameter of each of which is substantially equal to the diameter of the cylindrical pivots of the swingable member.

3. A connector as claimed in claim 1 in which the bearing housing comprises a pair of oppositely disposed plate elements adjacent the side walls of the housing, said plate elements having substantially U-shaped recesses for pivotably mounting of the swingable member within the housing.

4. A connector as claimed in claim 1 in which the substantially U-shaped recesses for pivotable mounting of the swingable member are provided in a pair of oppositely disposed side walls of the bearing housing.

5. A connecting member as claimed in claim 1 in which a pair of oppositely disposed side walls of the housing disposed perpendicularly to the swinging plane of the swingable member are provided with recesses for enabling the swingable connector to move into its extreme positions.

* * * * *